US005351585A

United States Patent [19]

Leseberg et al.

[11] Patent Number: 5,351,585

[45] Date of Patent: Oct. 4, 1994

[54] LARGE CAPACITY LOCKING PLIERS

[75] Inventors: Terry G. Leseberg, Marysville, Kans.; Gene L. Tyser, Wilbur, Nebr.

[73] Assignee: Petersen Manufacturing Co. Inc., Dewitt, Nebr.

[21] Appl. No.: 105,431

[22] Filed: Aug. 11, 1993

[51] Int. Cl.[5] ..... B25B 7/02; B25B 7/12

[52] U.S. Cl. ..... 81/426; 81/370

[58] Field of Search ..... 82/424.5, 426, 426.5, 82/418, 367–383

[56] References Cited

U.S. PATENT DOCUMENTS

| | | | |
|---|---|---|---|
| D. 260,476 | 9/1981 | Knaus . | |
| 928,849 | 7/1909 | Carlson . | |
| 2,558,440 | 6/1951 | Johnson . | |
| 2,561,682 | 7/1951 | Barnett . | |
| 2,711,663 | 6/1955 | Petersen | 81/370 |
| 3,195,382 | 7/1965 | Rommel et al. . | |
| 3,336,825 | 8/1967 | Cashion . | |
| 3,585,704 | 6/1971 | Schroeder | 81/418 X |
| 3,894,451 | 7/1975 | Putsch . | |
| 4,505,011 | 3/1985 | Dupuy . | |
| 4,541,312 | 9/1985 | Petersen . | |
| 4,546,680 | 10/1985 | Petersen . | |
| 4,709,601 | 12/1987 | Petersen . | |
| 4,730,524 | 3/1988 | Petersen . | |
| 4,989,479 | 2/1991 | Anderson et al. . | |
| 5,222,386 | 6/1993 | Jones, Jr. . | |

OTHER PUBLICATIONS

"Vise-Grip, Quick-Grip, Prosnip, Unibit, Chesco Catalog", pp. 1–9, American Tool Companies, 1993 (U.S.A.).

"General Program '92GB", p. 4, Beta Utensili, 1992.

"Ihr Werkzeugpartner D92" p. 111, Gedore, 1992 (Germany).

"Grip-on" p. 5, 1992.

"Llaves Grip" 1992.

"Irimo la herramienta" p. 99, Irimo, 1992.

"URBO Spannwerkzeuge-Program-Information" pp. 1–4, 1992 (Germany).

"Roux Outillage", pp. 1–4, 1992 (France).

Photographs-Three locking pliers dated Jun. 1993.

Photographs-Facom pliers, 1993.

Photograph and drawings-Petersen Bicycle Tool Plier, 1993.

*Primary Examiner*—D. S. Meislin

*Attorney, Agent, or Firm*—Willian Brinks Hofer Gilson & Lione

[57] ABSTRACT

A large capacity locking pliers includes a body, a fixed jaw, a movable jaw, and an over-center toggle linkage secured between the movable jaw and the body to lock the movable jaw in position with respect to the fixed jaw. The jaws define respective working surfaces, and each of the working surfaces defines an end portion, an intermediate portion, and a concave inner portion. The concave inner portion of the fixed jaw extends over an arc $\alpha$ of at least 45° and the concave inner portion of the movable jaw extends over an arc $\beta$ of at least 80°. These concave inner portions are concentric when the movable jaws move to a selected open position to grip a large cylindrical workpiece. The fixed and movable jaws are asymmetrical in order to facilitate fabrication and finishing of the completed pliers.

13 Claims, 2 Drawing Sheets

LARGE CAPACITY LOCKING PLIERS

BACKGROUND OF THE INVENTION

This invention relates to locking pliers of the type having a fixed jaw, a movable jaw, and an over-center toggle linkage secured to the movable jaw to pivot the movable jaw about a pivot axis and to lock the movable jaw in position with respect to the fixed jaw.

Many conventional locking pliers suffer from the disadvantage of an inefficient gripping geometry for large diameter workpieces. If an attempt is made to close a conventional locking pliers on a large diameter workpiece, the closing forces may tend to move the workpiece out of the open jaws, in some cases preventing a stable grip from being obtained.

The present invention is directed to an improved locking pliers which is well suited to grip both large and small diameter workpieces, while reducing or eliminating any tendency of the workpiece to be pushed out of the pliers as the jaws are closed.

SUMMARY OF THE INVENTION

According to this invention, a large capacity locking pliers is provided comprising a body, a fixed jaw and a movable jaw. The fixed jaw is secured to the body and comprises a first working surface. This first working surface comprises a first end portion, a first intermediate portion, and a first concave inner portion. The movable jaw is pivotably mounted to the body to pivot with respect to the fixed jaw about a pivot axis that is fixed with respect to the body. This movable jaw comprises a second working surface opposed to the first working surface, and this second working surface comprises a second end portion, a second intermediate portion, and a second concave inner portion. An over-center toggle linkage is secured between the movable jaw and the body to pivot the movable jaw about the pivot axis and to lock the movable jaw in position with respect to the fixed jaw. The first and second end portions are positioned to abut one another in surface contact when the movable jaw is moved to a selected closed position. The body defines a longitudinal axis extending between the first end portion and a central portion of an end of the body remote from the fixed jaw, and the longitudinal axis passes adjacent to the pivot axis.

According to a first aspect of this invention, the first concave inner portion extends over an arc $\alpha$ of at least 45 degrees, the second concave inner portion extends over an arc $\beta$ of at least 80 degrees and greater than the arc $\alpha$, and the concave inner portions are concentric when the movable jaw is moved to a selected open position to grip a large cylindrical workpiece.

According to a second aspect of this invention, the locking pliers defines a jaw axis extending between the pivot axis and the first end portion. The first concave inner portion deviates from the jaw axis by a maximum value equal to X and the second inner portion when in the selected closed position deviates from the jaw axis by a maximum value equal to Y. The ratio X/Y is less than 0.5, preferably less than 0.4, and most preferably substantially equal to 0.3.

As will be apparent from the following description of the presently preferred embodiment, this embodiment allows a large diameter workpiece to be gripped without any tendency for the workpiece to move out of the region between the jaws as the jaws are closed. Furthermore, the preferred embodiment described below is compact, and the fixed jaw is shaped to facilitate fabrication and finishing.

The invention itself, together with further features and advantages, will best be understood by reference to the following detailed description, taken in conjunction with the accompanying drawings.

DETAILED DESCRIPTION OF THE PRESENTLY PREFERRED EMBODIMENTS

Figure 1:
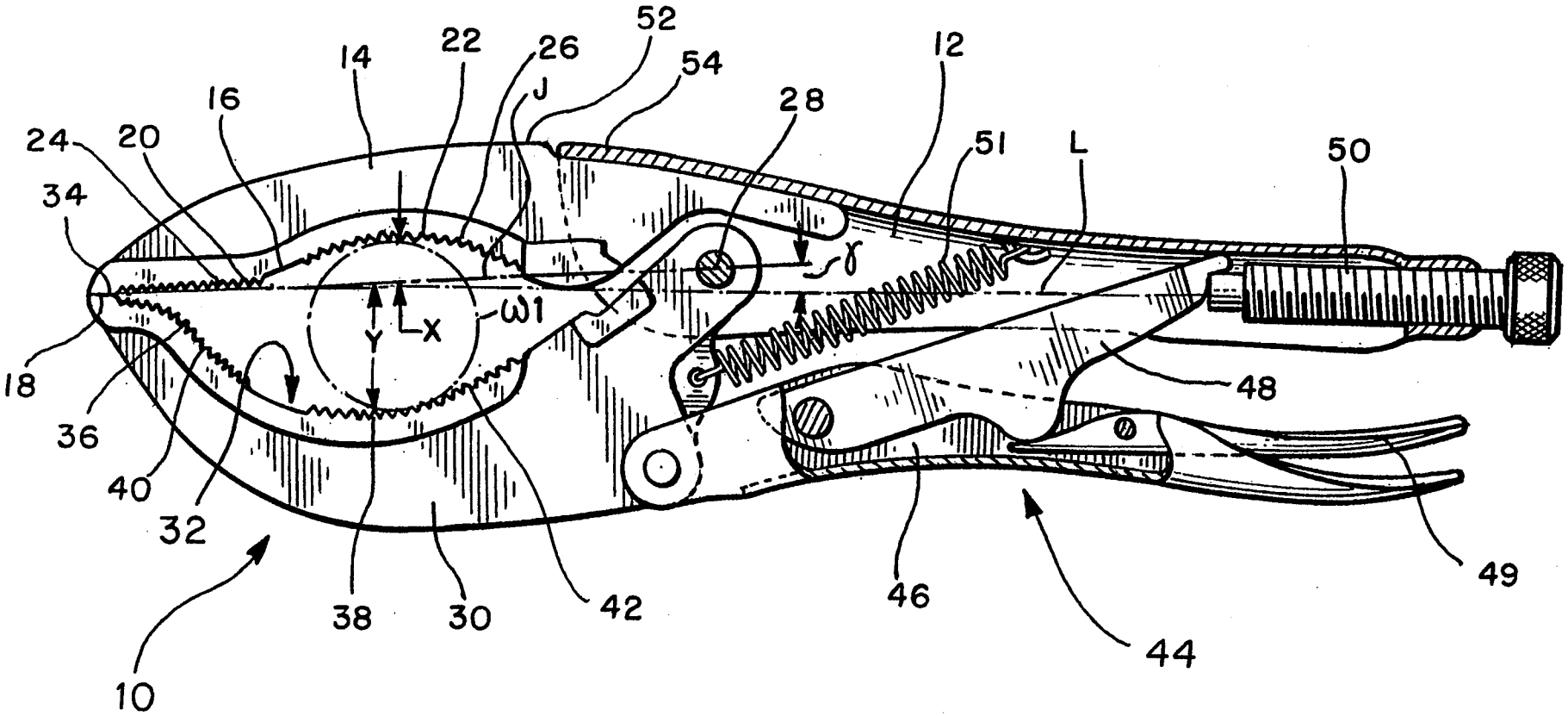
FIG. 1 is a side view of a locking pliers which incorporates a preferred embodiment of this invention, showing the pliers in the closed position.

Turning now to the drawings, FIG. 1 shows a side view of a locking pliers 10 which incorporates a preferred embodiment of this invention. In FIG. 1, the locking pliers 10 is shown in the closed position.

The locking pliers 10 includes a body 12 which is fixedly secured to a fixed jaw 14. The fixed jaw 14 defines a first working surface 16 which is made up of three parts: a first end portion 18 positioned remote from the body 12, a first intermediate portion 20, and a first concave inner portion 22. In this embodiment the first end portion 18 is flat, but it may be toothed, knurled, or smooth, depending upon the application. The first intermediate portion 20 in this embodiment is cylindrically convex, and it defines an array of teeth 24. The first concave inner portion 22 in this embodiment is cylindrically concave, and it has a cylinder radius that is preferably greater than 1 inch and most preferably equal to about 1.5 inch. The first cylindrical part 22 defines an array of gripping teeth 26.

The body 12 defines a pivot axis 28 which is fixed in place on the body 12, and a movable jaw 30 is mounted to pivot around the pivot axis 28. The movable jaw 30 defines a second working surface 32 which is opposed to the first working surface 16 so as to grip a workpiece therebetween. The second working surface 32 is formed of a second end portion 34, a second intermediate portion 36, and a second concave inner portion 38. In this embodiment the second end portion 34 is flat, the second intermediate portion 36 is cylindrically convex, and the second concave inner portion 38 is cylindrically concave. The second intermediate portion 36 and the second concave inner portion 38 define respective arrays of teeth 40,42. The second concave inner portion 38 preferably defines a cylinder radius equal to that of the first concave inner portion 22, preferably greater than 1 inch, and most preferably equal to about 1.5 inch.

The position of the movable jaw 30 with respect to the fixed jaw 14 is controlled by an over-center toggle linkage 44 which both pivots the movable jaw 30 with respect to the body 12 and locks the movable jaw 30 in position. The over-center toggle linkage 44 includes a lever 46 that is pivoted to the movable jaw 30 and adapted to be gripped by a user. The over-center toggle linkage 44 also includes a stub arm 48 which is pivotably mounted to the lever 46 and a screw 50 which is threadedly coupled to the body 12 such that one end of the screw 50 bears on an end of the stub arm 48 as shown in FIG. 1 to adjust the toggle linkage. A release lever 49 is pivoted to the lever 46 to contact the stub arm 48.

The over-center toggle linkage 44 operates in the conventional manner such that a user can close the jaws by bringing the lever 46 close to the body 12. The over-center toggle linkage 44 locks the lever 46 in the closed position, and the release lever 49 is used to release the over-center toggle linkage 44.

An extension coil spring 51 is mounted between the body 12 and the movable jaw 30 to bias the movable jaw 30 to an open position.

FIG. 1 shows the pliers 10 in a closed position, in which the first and second end portions 18,34 meet in surface contact. The pliers 10 defines a longitudinal axis L which extends between the first end portion 18 and a central part of the end of the body 12 remote from the fixed jaw 14. As shown in FIG. 1, the longitudinal axis L passes adjacent to the pivot axis 28, and the screw 50 is substantially centered on and aligned with the longitudinal axis L. The pliers 10 also defines a jaw axis J which extends between the center of the pivot axis 28 and the first end portion 18 of the first working surface 16.

As shown in FIG. 1, the jaws 14,30 are asymmetrical. One measure of the extent of asymmetry is provided by the parameters X and Y. X is defined as the maximum value by which the first concave inner portion 22 deviates from the jaw axis J, and Y is defined as the maximum value by which the second concave inner portion 38 deviates from the jaw axis J when the movable jaw 30 is in the closed position of FIG. 1, with the first and second end portions 18,34 in contact. The ratio X/Y is a measure of the asymmetry of the jaws. Preferably, the ratio X/Y is less than 0.5, more preferably less than 0.4, and most preferably substantially equal to 0.3.

It has been found with this arrangement that the fixed jaw 14 can be shaped for efficient fabrication and finishing. In particular, the fixed jaw 14 defines a first outer convex surface 52 adjacent to the body 12, and the body 12 defines a second convex outer surface 54 adjacent to the fixed jaw 14. As shown in FIG. 1, the first outer convex surface 52 continues and extends the second outer convex surface 54 without inflection. A line drawn tangent to the first convex outer surface 52 adjacent to the body 12 is substantially parallel to the longitudinal axis L. This arrangement allows a surface grinder to be used to insure a smooth transition between the body 12 and the fixed jaw 14 at the first and second convex outer surfaces 52,54.

Figure 2:
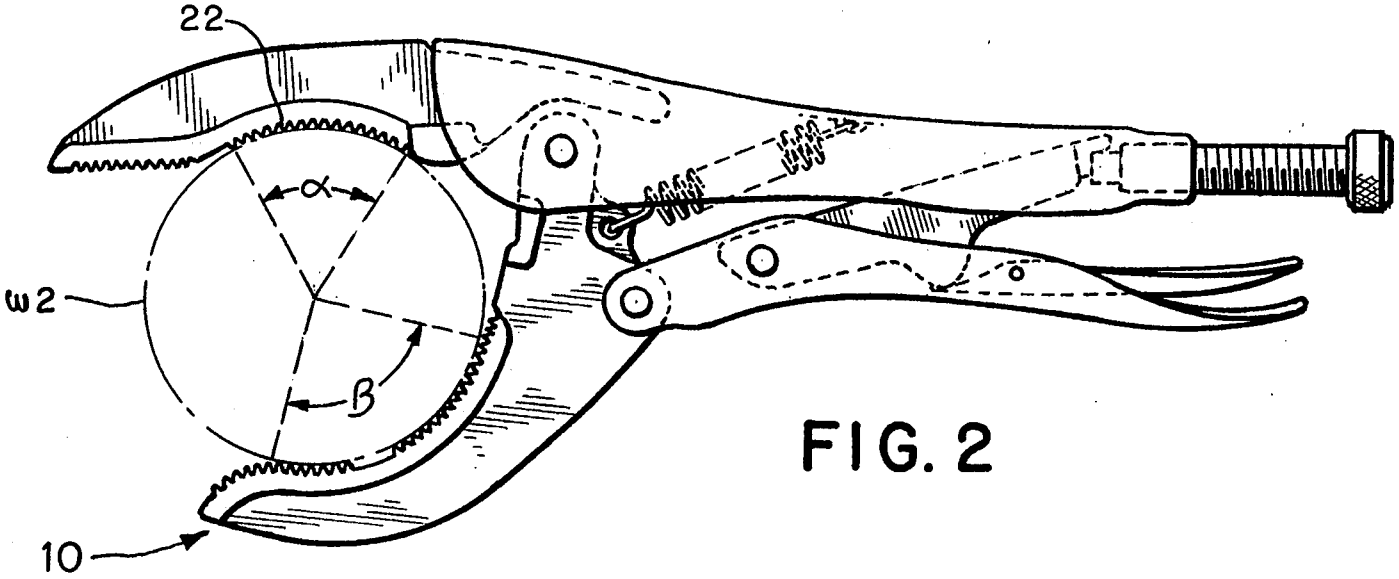
FIG. 2 is a side view of the locking pliers of FIG. 1 showing the jaws closed about a large diameter cylindrical workpiece.
Figure 3:
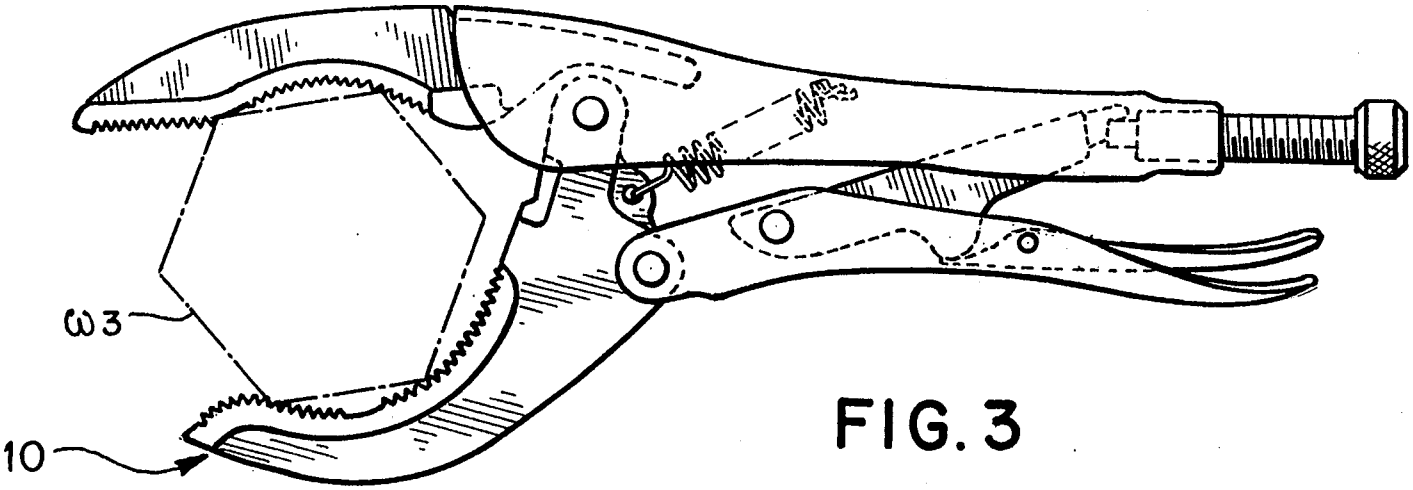
FIG. 3 is a side view corresponding to FIG. 1 showing the jaws closed about a large diameter hexagonal workpiece.

As shown in FIGS. 2 and 3, the locking pliers 10 is well suited for clamping large workpieces. As shown in FIG. 2, the first concave inner portion 22 extends over an arc $\alpha$, the second concave inner portion 38 extends over an arc $\beta$, and the two inner portions 22,38 are of equal cylinder radius and concentric when the pliers is positioned as shown in FIG. 2. because of the large arc $\beta$, with little or no tendency of the workpiece to move out of the pliers 10. The arc $\alpha$ is preferably greater than 45° and most preferably substantially equal to 60°. The arc $\beta$ is preferably greater than 80°, and most preferably substantially equal to 90°.

The locking pliers 10 works efficiently with workpieces that vary in size over a wide range. In this preferred embodiment, the workpiece W1 shown in FIG. is about 1.2 inch in diameter, and the workpiece W2 shown in FIG. 2 is about 3.0 inch in diameter. As shown in FIG. 3, the locking pliers 10 is also well suited for gripping a large hexagonal workpiece W3.

The following details of construction are provided in order to define the best mode of the invention presently contemplated by the inventor. It should be clearly understood however, that these details of construction are only intended by way of illustration, and are in no way intended to limit the scope of this invention. In the preferred embodiment of this invention the body 12 and the over-center toggle linkage 44 are completely conventional, and can be formed for example as described in U.S. Pat. No. 4,541,312. The body 12 can be formed of a sheet of metal which forms a pocket that receives the fixed jaw 14 and the movable jaw 30, along with the screw 50 and the stub shaft 48. In this preferred embodiment the arc $\alpha$ is substantially equal to 60°, the arc $\beta$ is substantially equal to 90°, and the cylindrical radius of curvature of the concave inner portions 22, 38 is equal to 1.5 inch. The angle $\gamma$ between the jaw axis J and the longitudinal axis L is small, preferably less than 30°, and substantially equal to 2.3° in this embodiment. The jaws 14,30 can be formed of any suitable material such as type 9260 high alloy, medium carbon spring steel, and can be case hardened to a hardness of 49–54 on the Rockwell C Scale.

It should be apparent from the foregoing description that the locking pliers 10 is relatively compact for its gripping capacity. It is well suited for use with large capacity objects, and it provides all of the advantages of a fixed as opposed to an adjustable pivot axis for the movable jaw 30. The outer convex surface of the fixed jaw 14 continues and extends the outer convex surface of the body 12, which makes the assembly relatively inexpensive to fabricate and to finish. Because the end portions 18, 34, the pivot axis 28, and the screw 50 are all substantially in alignment, the pliers 10 is well suited for use in confined spaces.

Of course, it should be understood that a wide range of changes and modifications can be made to the preferred embodiment described above. For example, details of sizing and proportions for the jaws can be altered as appropriate for the application. It is therefore intended that the foregoing detailed description be regarded as illustrative rather than limiting, and that it be understood that it is the following claims, including all equivalents, which define the scope of this invention.

We claim:

1. A large capacity locking pliers comprising a body;

a fixed jaw secured to the body and comprising a first working surface, said first working surface comprising a first end portion, a first intermediate portion, and a first concave inner portion;

a movable jaw pivotably mounted to the body to pivot with respect to the fixed jaw about a pivot axis that is fixed with respect to the body, said movable jaw comprising a second working surface opposed to the first working surface, said second working surface comprising a second end portion, a second intermediate portion, and a second concave inner portion;

an over-center toggle linkage secured between the movable jaw and the body to pivot the movable jaw about the pivot axis and to lock the movable jaw in position with respect to the fixed jaw;

said first concave inner portion extending over an arc $\alpha$ of at least 45°, said second concave inner portion extending over an arc $\beta$ of at least 80° and greater than the arc $\alpha$, said concave inner portions being concentric when the movable jaw is moved to a selected open position to grip a large cylindrical workpiece;

said first and second end portions positioned to abut one another in surface contact when the movable jaw is moved to a closed position;

said body defining a longitudinal axis extending between the first end portion and a central portion of an end of the body remote from the fixed jaw;

said longitudinal axis passing adjacent to said pivot axis.

2. A large capacity locking pliers comprising a body;

a fixed jaw secured to the body and comprising a first working surface, said first working surface comprising a first end portion, a first intermediate portion, and a first concave inner portion;

a movable jaw pivotably mounted to the body to pivot with respect to the fixed jaw about a pivot axis that is fixed with respect to the body, said movable jaw comprising a second working surface opposed to the first working surface, said second working surface comprising a second end portion, a second intermediate portion, and a second concave inner portion;

an over-center toggle linkage secured between the movable jaw and the body to pivot the movable jaw about the pivot axis and to lock the movable jaw in position with respect to the fixed jaw;

said first and second end portions positioned to abut one another in surface contact when the movable jaw is moved to a closed position;

said body defining a longitudinal axis extending between the first end portion and a central portion of an end of the body remote from the fixed jaw;

wherein the locking pliers defines a jaw axis extending between the pivot axis and the first end portion, wherein the first concave inner portion deviates from the jaw axis by a maximum value equal to X at a first location on the jaw axis, wherein the second inner portion when in the closed position deviates from the jaw axis by a maximum value equal to Y at a second location on the jaw axis, wherein X/Y is less than 0.5, and wherein the first location is disposed between the pivot axis and the second location on the jaw axis; and wherein said first concave inner portion extends over a lesser arc than the second concave inner portion such that the first and second working surfaces differ from one another in shape.

3. The invention of claim 1 or 2 wherein the concave inner portions are cylindrical in shape with a cylinder radius greater than one inch, and wherein the concave inner portions each define a respective array of teeth.

4. The invention of claim 3 wherein the cylinder radius is about 1.5 inch.

5. The invention of claim 3 wherein the intermediate portions are cylindrically convex, and wherein the intermediate portions each define a respective array of teeth.

6. The invention of claim 1 or 2 wherein the toggle linkage comprises:

a lever pivotably mounted to the movable jaw;

a stub arm pivotably mounted to the lever; and a screw threaded to the body and comprising an end that bears on the stub arm such that rotation of the screw adjusts the toggle linkage.

7. The invention of claim 6 wherein the screw is centered on and substantially aligned with the longitudinal axis.

8. The invention of claim 3 wherein said first concave inner portion extends over an arc of at least about 60°, and wherein said second concave inner portion extends over an arc of at least about 90°.

9. The invention of claim 1 wherein the locking pliers defines a jaw axis extending between the pivot axis and the first end portion, wherein the first concave inner portion deviates from the jaw axis by a maximum value equal to X, wherein the second concave inner portion when in the closed position deviates from the jaw axis by a maximum value equal to Y, and wherein X/Y is less than 0.5.

10. The invention of claim 2 or 9 wherein X/Y is less than 0.4.

11. The invention of claim 10 wherein X/Y is substantially equal to 0.3.

12. The invention of claim 1 or 2 wherein the fixed jaw defines a first outer convex surface adjacent the body, wherein the body defines a second outer convex surface adjacent the fixed jaw, and wherein the first outer convex surface continues and extends the second outer convex surface without inflection .

13. The invention of claim 12 wherein a line tangent to the first outer convex surface adjacent to the body is substantially parallel to the longitudinal axis.

* * * * *